US009291393B2

(12) United States Patent
Knowles

(10) Patent No.: US 9,291,393 B2
(45) Date of Patent: Mar. 22, 2016

(54) RETRACTABLE CLOTHES DRYER VENT

(71) Applicant: Lonnie Sheldon Knowles, Elmira, NY (US)

(72) Inventor: Lonnie Sheldon Knowles, Elmira, NY (US)

( * ) Notice: Subject to any disclaimer, the term of this patent is extended or adjusted under 35 U.S.C. 154(b) by 156 days.

(21) Appl. No.: 14/262,939

(22) Filed: Apr. 28, 2014

(65) Prior Publication Data

US 2014/0317949 A1 Oct. 30, 2014

Related U.S. Application Data

(60) Provisional application No. 61/816,768, filed on Apr. 28, 2013.

(51) Int. Cl.
*D06F 58/06* (2006.01)
*F26B 25/08* (2006.01)

(52) U.S. Cl.
CPC ..... *F26B 25/08* (2013.01)

(58) Field of Classification Search
CPC ..... F26B 21/00; F26B 21/06; F26B 25/00; F26B 25/06; D06F 58/00; D06F 58/28; F24B 1/00; F24B 1/188
USPC ..... 34/595, 601, 606, 610; 68/5 C, 5 R, 19, 68/20; 8/139, 149, 159; D32/25, 28; 454/275, 283
See application file for complete search history.

(56) References Cited

U.S. PATENT DOCUMENTS 4,890,396 A 1/1990 King
5,121,948 A 6/1992 Anderson et al.
5,145,217 A 9/1992 Anderson et al.
5,257,468 A * 11/1993 Lebrun ..... D06F 58/00 285/189
5,318,328 A * 6/1994 Dawson ..... D06F 58/04 285/148.2
5,476,183 A 12/1995 Harpenau
5,584,129 A 12/1996 Williamson
5,590,477 A 1/1997 Carfagno, Sr.
5,970,623 A * 10/1999 Tuggle ..... D06F 58/20 34/134
6,098,312 A * 8/2000 Tuggle ..... D06F 58/20 285/183
6,195,910 B1 * 3/2001 Robineau ..... D06F 58/20 34/235
6,550,157 B1 4/2003 Harding
6,578,286 B2 6/2003 Seeley
6,584,702 B2 7/2003 Irey (Continued)

FOREIGN PATENT DOCUMENTS

CA 2430250 A1 * 11/2004 ..... D06F 58/20

*Primary Examiner* — Stephen M Gravini
(74) *Attorney, Agent, or Firm* — Brown & Michaels, PC

(57) ABSTRACT

A retractable clothes dryer vent includes a support, a duct coupling, a dryer vent hose, a dryer exhaust coupling, a first retraction guide assembly, and a second retraction guide assembly. The duct coupling is mounted in the support and has a first end, a second end opposite the first end, and an opening extending through the support. The dryer vent hose has a first end extending from the first end of the duct coupling and a second end opposite the first end. The dryer exhaust coupling extends from the second end of the dryer vent hose. The first retraction guide assembly has a first end mounted to the support and a second end anchored to the dryer exhaust coupling. The second retraction guide assembly has a first end mounted to the support and a second end anchored to the dryer exhaust coupling.

15 Claims, 11 Drawing Sheets

(56) References Cited

U.S. PATENT DOCUMENTS

| | | | | |
|---|---|---|---|---|
| 6,729,586 | B2 | 5/2004 | Arguijo et al. | |
| 7,213,349 | B1 * | 5/2007 | Brunner et al. | D06F 58/20 34/86 |
| 7,240,930 | B2 | 7/2007 | Stravitz | |
| 7,383,645 | B2 * | 6/2008 | Kong | D06F 58/20 34/601 |
| 7,421,803 | B2 * | 9/2008 | Charron | E04F 17/04 285/192 |
| 7,421,804 | B1 * | 9/2008 | Hession | D06F 58/20 34/601 |
| 7,731,045 | B2 | 6/2010 | Harpenau | |
| 8,333,184 | B2 * | 12/2012 | Gallo | F24B 1/207 126/507 |
| 2014/0317949 | A1 * | 10/2014 | Knowles | F26B 25/08 34/235 |

* cited by examiner

RETRACTABLE CLOTHES DRYER VENT

REFERENCE TO RELATED APPLICATIONS

This application claims an invention which was disclosed in Provisional Application No. 61/816,768, filed Apr. 28, 2013, entitled "RETRACTABLE CLOTHES DRYER VENT". The benefit under 35 USC §119(e) of the United States provisional application is hereby claimed, and the aforementioned application is hereby incorporated herein by reference.

BACKGROUND OF THE INVENTION

1. Field of the Invention

The present invention relates generally to exhaust vent systems for clothes dryers. More specifically it relates to a retractable clothes dryer vent for providing an easier clothes dryer vent connection and a reduced risk of fire.

2. Description of Related Art

When a clothes dryer is installed in a building, it must be vented to the outside. It is difficult to make this connection because the dryer's exhaust pipe is usually located at the lower portion of the back of the dryer. The connection is usually done by, but not limited to, one of the following methods.

The easiest solution has been to use a flexible dryer hose to connect the clothes dryer exhaust pipe to the outside vent. The flexible dryer vent hose is not only flexible but it is also accordion-like in that its length can be extended and collapsed, which allows attaching it to the clothes dryer while the clothes dryer is away from the rear wall. After the connection, the dryer is moved close to the rear wall which usually kinks the flexible vent hose. The kinks in the dryer vent hose result in numerous fires every year. Kinks in the dryer vent hose can also cause a restriction that reduces dryer efficiency. In gas dryers, that restriction can cause dangerous exhaust gases to be emitted into the building in which the clothes dryer is installed.

U.S. Pat. No. 5,121,948 to Anderson et al., hereby incorporated by reference herein, discloses an assembly of lengths of rigid pipe connected together with a number of elbows. The configuration brings the connection of the clothes dryer to the outside duct to the top of the dryer, enabling the installer the ability to make the connection after the clothes dryer is installed. This method does not allow the clothes dryer to be installed tight to the wall behind the clothes dryer, because several inches of space between the dryer and the wall are necessary to accommodate the pipe and elbows. It is also difficult and time consuming to install, because several pipes need to be cut to the correct length and then assembled with several elbows to obtain the correct configuration. This system must also be disconnected to move the dryer away from the rear wall for servicing.

Another solution has been to connect the clothes dryer exhaust tube directly to the wall vent. This is the most difficult. The wall vent to the outside must be meticulously installed to align exactly with the clothes dryer exhaust. Even then it is usually necessary for two people to do the installation: one to push the dryer into position while the other lies down and reaches behind the dryer to align the dryer exhaust with the outside duct. Another drawback to this method is if a new dryer has to be installed, the wall vent to the outside will have to be moved unless the new dryer is the same make and model as the old dryer.

SUMMARY OF THE INVENTION

A retractable clothes dryer vent includes a support, a duct coupling, a dryer vent hose, a dryer exhaust coupling, a first retraction guide assembly, and a second retraction guide assembly. The duct coupling is mounted in the support and has a first end, a second end opposite the first end, and an opening extending through the support. The dryer vent hose has a first end extending from the first end of the duct coupling and a second end opposite the first end. The dryer exhaust coupling extends from the second end of the dryer vent hose. The first retraction guide assembly has a first end mounted to the support and a second end anchored to the dryer exhaust coupling. The second retraction guide assembly has a first end mounted to the support and a second end anchored to the dryer exhaust coupling.

A method of installing a clothes dryer includes pulling a dryer exhaust coupling of a retractable clothes dryer vent, mounted to a wall of a building, away from the wall. The method also includes attaching the dryer exhaust coupling to a dryer exhaust tube of the clothes dryer and moving the clothes dryer to an operational position at the wall with the dryer exhaust coupling attached to the dryer exhaust tube located vertically below the duct coupling.

DETAILED DESCRIPTION OF THE INVENTION

A. Overview

Figure 1:
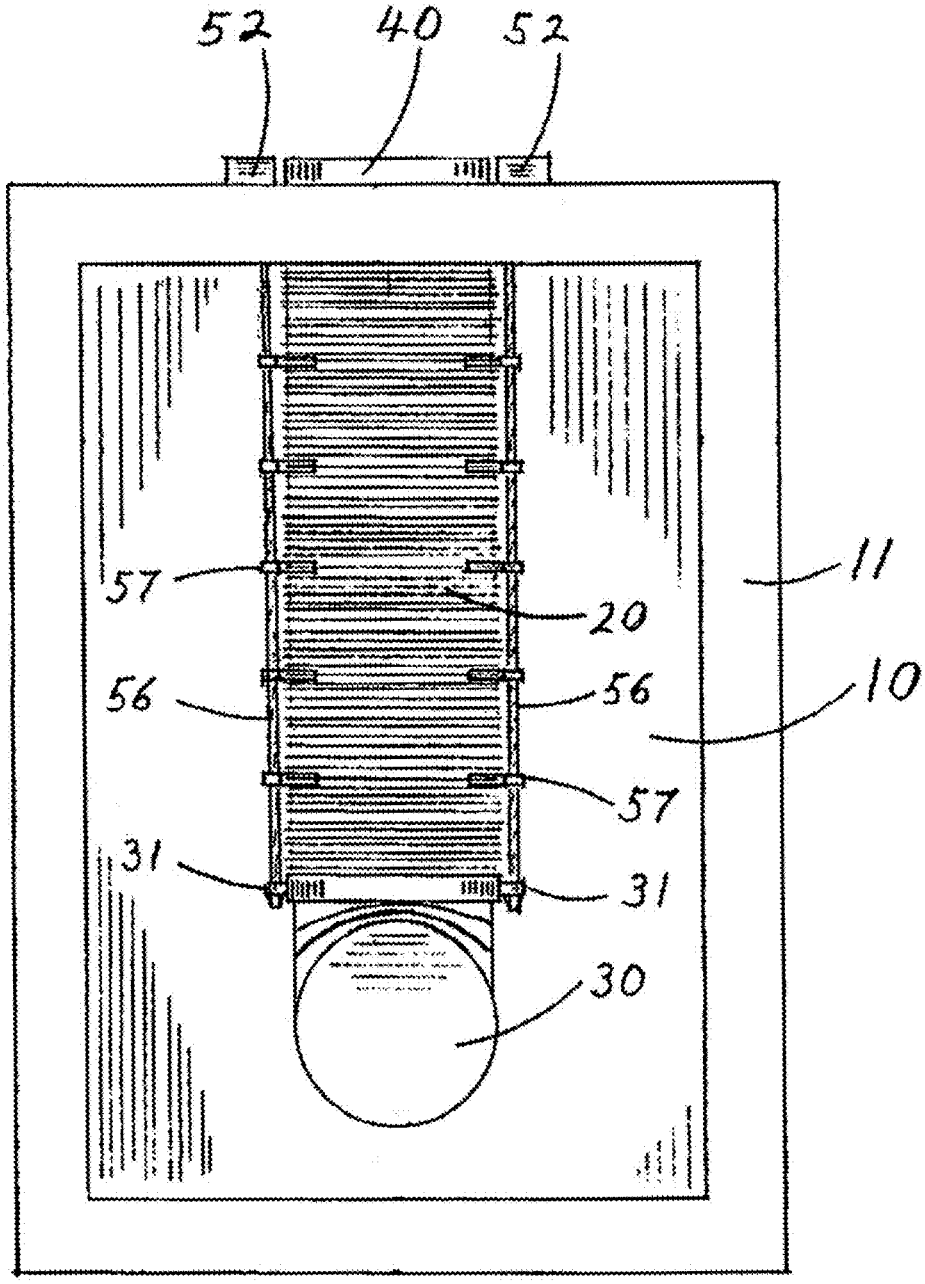
FIG. 1 shows a front view of a retractable clothes dryer vent in an embodiment of the present invention.
Figure 2:
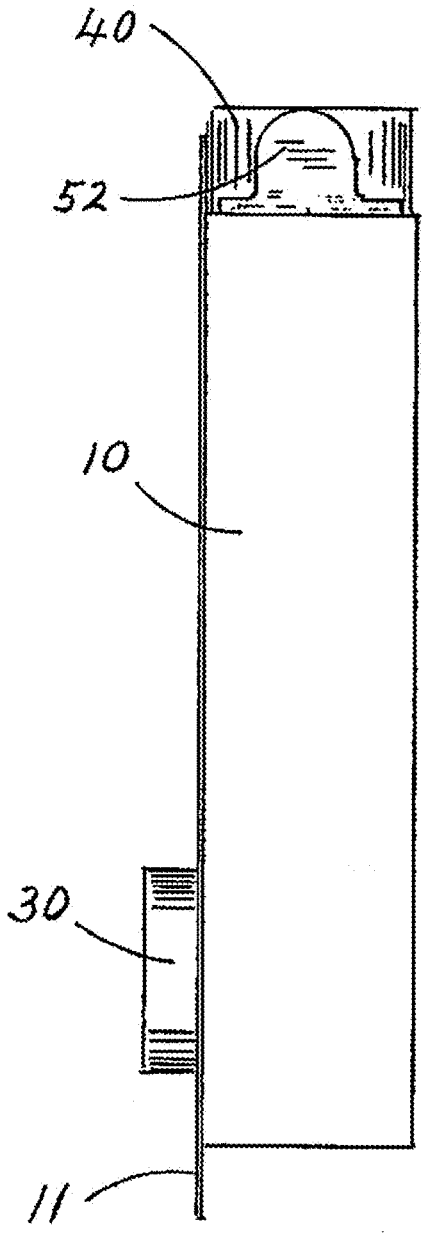
FIG. 2 shows a right side view of the retractable clothes dryer vent of FIG. 1.
Figure 3:
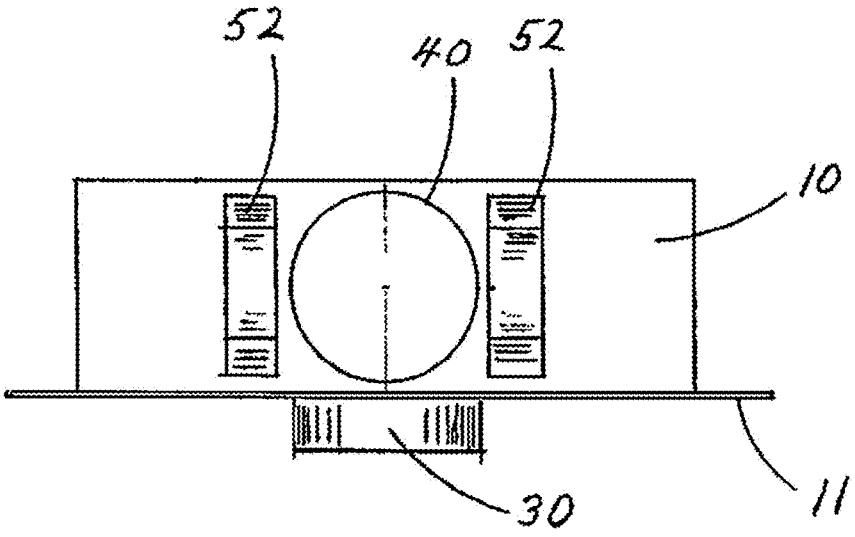
FIG. 3 shows a top view of the retractable clothes dryer vent of FIG. 1.
Figure 4:
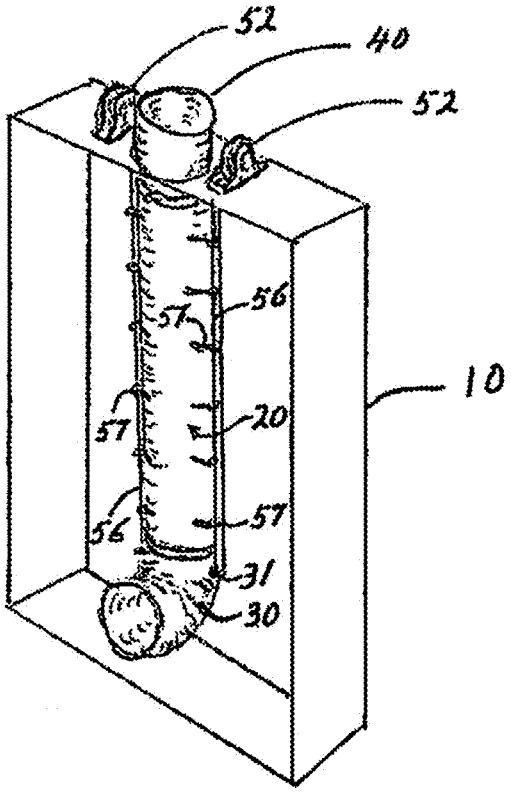
FIG. 4 shows an upper perspective view of the retractable clothes dryer vent of FIG. 1 in a retracted position.

A retractable clothes dryer vent preferably addresses the difficulty of connecting a clothes dryer exhaust safely to an outside vent.

A retractable clothes dryer vent preferably provides an easier clothes dryer vent connection.

A retractable clothes dryer vent preferably connects to a clothes dryer before the clothes dryer is moved into place.

A retractable clothes dryer vent preferably eliminates the kinking of a flexible dryer vent to prevent lint build-up, which can result in fire.

A retractable clothes dryer vent preferably eliminates the kinking of a flexible dryer vent hose to prevent exhaust restriction.

A retractable clothes dryer vent preferably allows the back of the dryer to be placed directly against a wall.

Turning now descriptively to the drawings, in which similar reference characters denote similar elements throughout the several views, the figures illustrate a support, a length of flexible dryer hose, a dryer exhaust coupling, a duct coupling, and a guide assembly.

B. Support

The support is preferably in the form of a vent housing (10), a shelf (22), or a wire frame (23).

Referring to FIG. 1 through FIG. 6, the vent housing (10) is a box having two parallel sides, a top and bottom which are also parallel to each other, a back, and an open front. The vent housing (10) is designed and sized to be recessed between wall studs and has a flange (11) to attach the vent housing (10) to the wall studs. The top of the vent housing (10) has an opening through which a duct coupling (40) is inserted. The duct coupling (40) is fastened to the top of the vent housing (10). The duct coupling (40) extends above and below the top of the vent housing (10). The upper end of the duct coupling (40) attaches to a duct that terminates through the outside wall of the building. The lower end of the duct coupling (40) has a flexible dryer vent hose (20) attached to it. Each spool housing (52) is attached to the top of the vent housing (10). A retractable line (56) passes down through a hole in the top of the vent housing (10).

Figure 8:
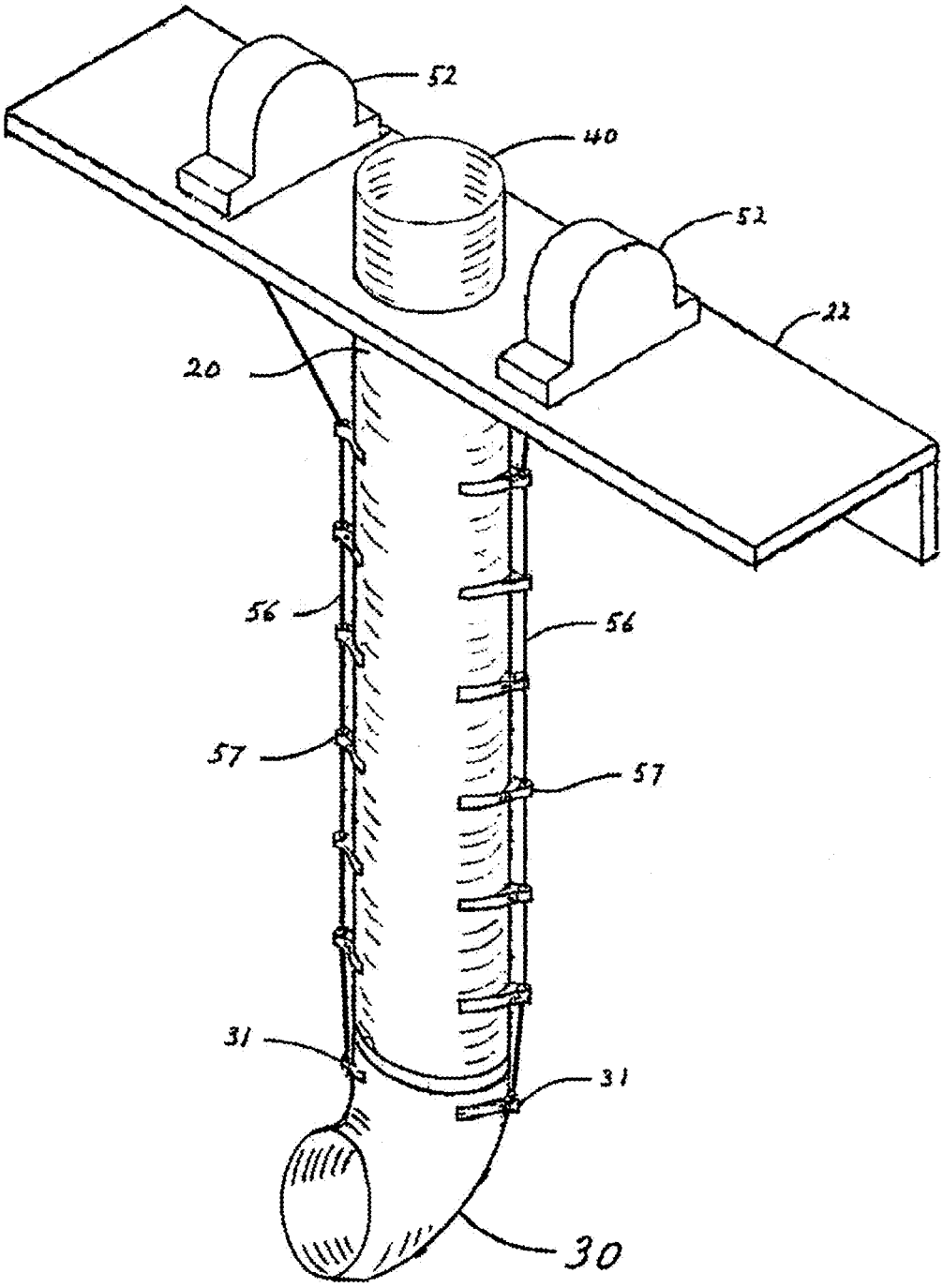
FIG. 8 shows an upper perspective view of the retractable clothes dryer vent of FIG. 1 including a shelf for support.
Figure 10:
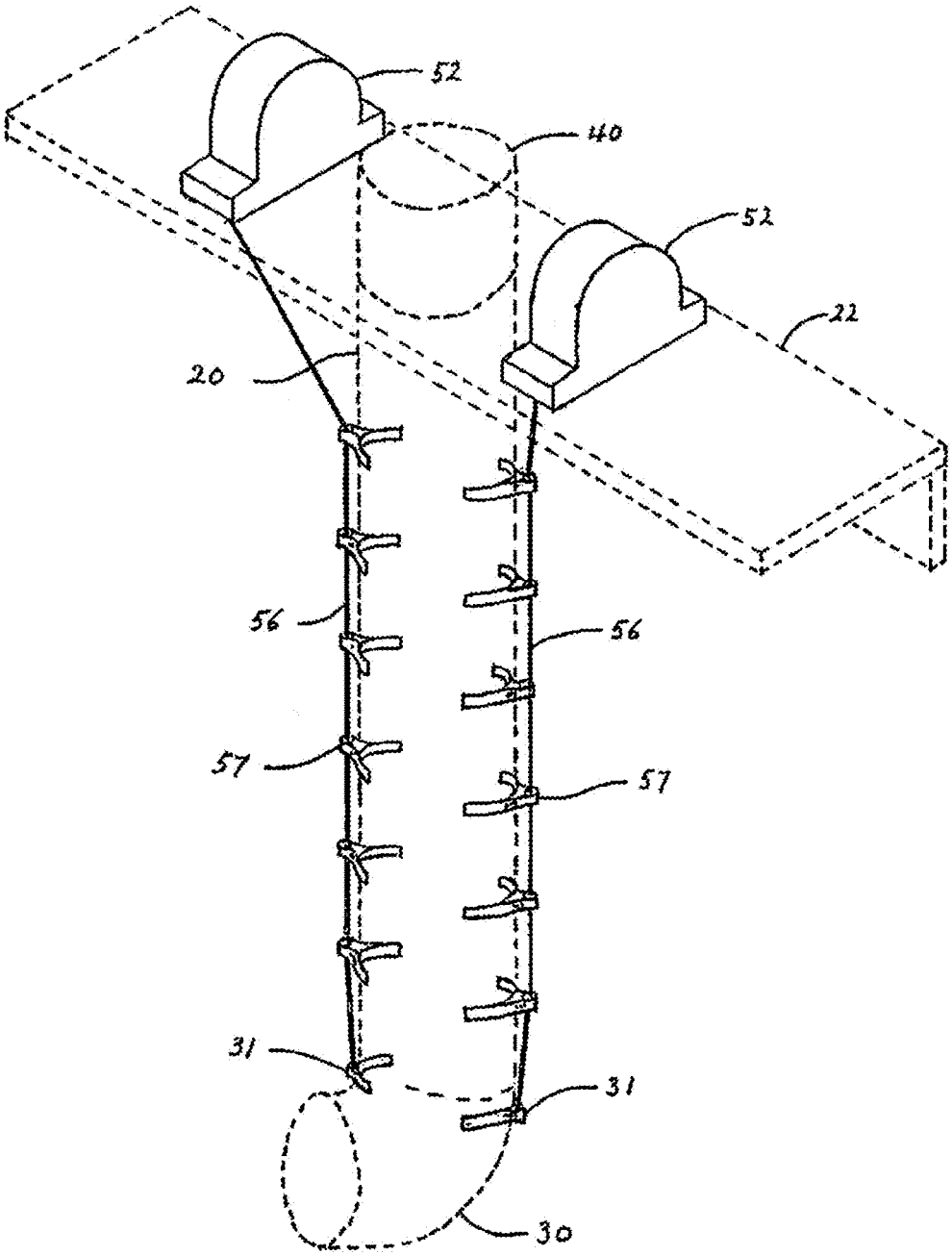
FIG. 10 shows an upper perspective view of a retraction guide assembly of a retractable clothes dryer vent in a retracted position.

Referring to FIG. 8 and FIG. 10, the shelf (22) is an alternative to the vent housing (10). The shelf (22) has an opening through which a duct coupling (40) is inserted. The duct coupling (40) is fastened to the shelf (22). The duct coupling (40) extends above the shelf (22) to allow attachment of the duct that terminates through the outside wall of the building. Each spool housing (52) is attached to the shelf (22). The retractable line (56) passes down through a hole in the shelf (22).

Figure 9:
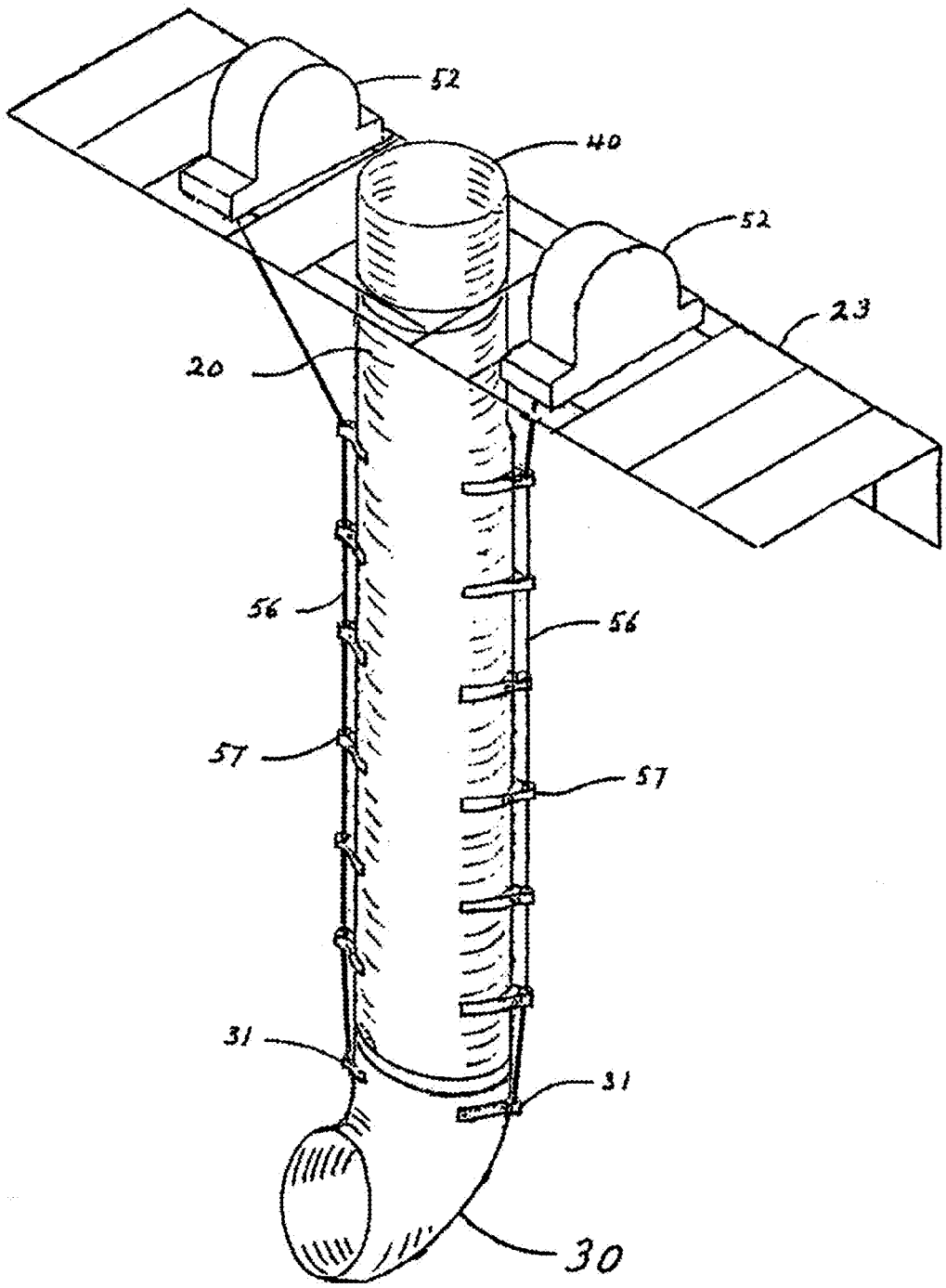
FIG. 9 shows an upper perspective view of the retractable clothes dryer vent of FIG. 1 including a wire bracket for support.

Referring to FIG. 9, the wire frame (23) is another alternative to the vent housing (10). The wire frame (23) has an opening through which the duct coupling (40) is inserted. The duct coupling (40) is fastened to the wire frame (23). The duct coupling (40) extends above the wire frame (23) to allow attachment of the duct that terminates through the outside wall of the building. Each spool housing (52) is attached to the wire frame (23). The retractable line (56) passes down through the wire frame (23).

C. Flexible Dryer Vent Hose

Figure 5:
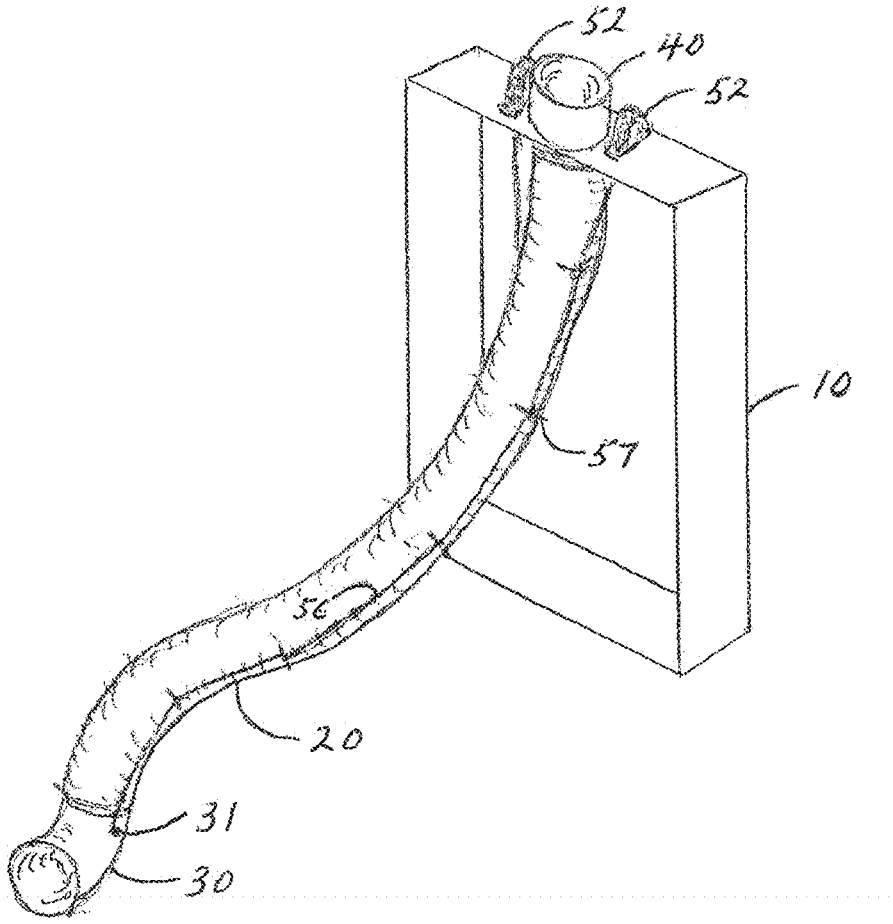
FIG. 5 shows an upper perspective view of the retractable clothes dryer vent of FIG. 1 in an extended position.
Figure 6:
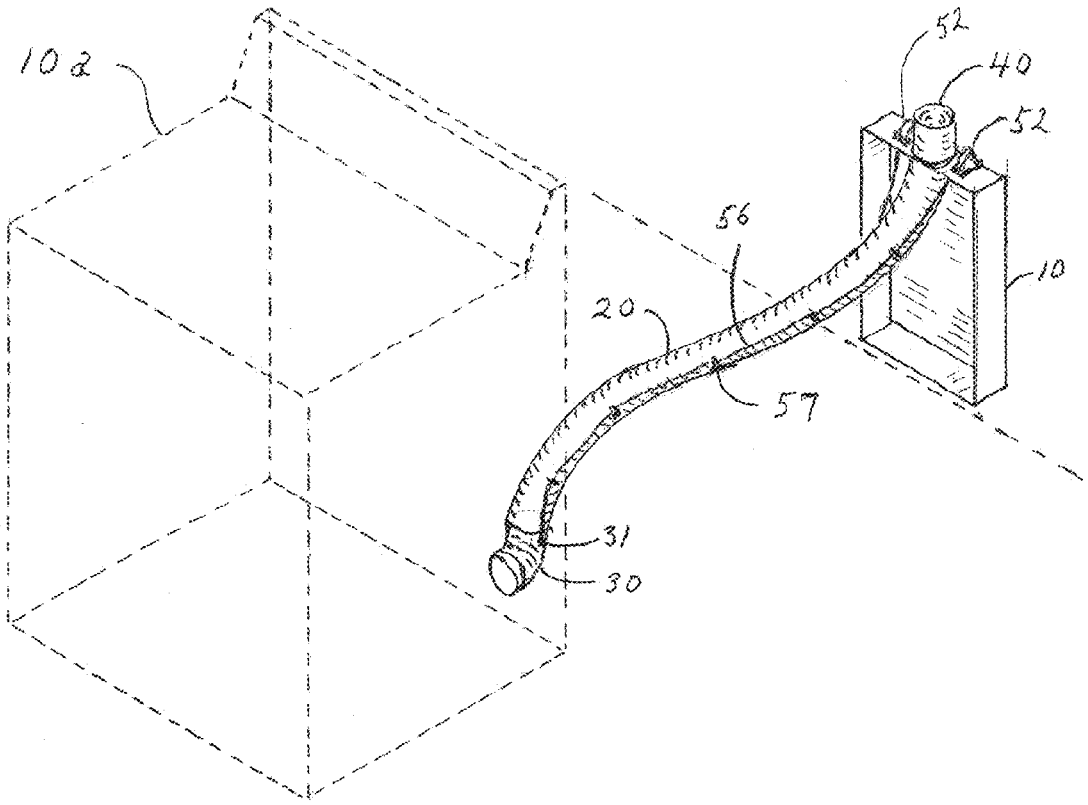
FIG. 6 shows an upper perspective view with a clothes dryer pulled away from the wall and attached to the retractable clothes dryer vent of FIG. 1.

As visible in FIG. 1 and FIG. 4 through FIG. 10, the flexible dryer vent hose (20) is a length of corrugated flexible dryer vent hose. When extended, as shown in FIG. 5 and FIG. 6, the flexible dryer vent hose (20) allows the dryer exhaust coupling (30) that is attached to the lower end of the flexible dryer vent hose (20) to be connected to a dryer (10*a*) before it is installed (see FIG. 6). The upper end of the flexible dryer hose (20) is connected to the duct coupling (40).

D. Dryer Exhaust Coupling

As visible in FIG. 1 through FIG. 10, a dryer exhaust coupling (30) is connected directly to the clothes dryer exhaust and allows the flexible dryer vent hose (20) to completely retract into the vent housing (10). There are two anchors (31) attached to either side of the dryer exhaust coupling (30). Two retractable lines (56) of the guide assembly are attached to these anchors.

The dryer exhaust coupling (30) has two ends. One end is connected to the lower end of the flexible dryer vent hose (20), and the other end is connectable to the clothes dryer's exhaust tube. The dryer exhaust coupling (30) has two anchors (31) attached to it. The end of one retractable line (56) is fastened to one of the anchors (31), and the end of the other retractable line (56) is fastened to the other anchor (31) One function of the dryer exhaust coupling (30) is to change the direction of flow of the exhaust after it leaves the dryer. Another function of the dryer exhaust coupling (30) is to allow easy attachment to the dryer. Another function of the dryer exhaust coupling (30) is to maintain the alignment of the flexible dryer hose (20), when the flexible dryer hose (20) retracts back into the vent housing (10). The dryer exhaust coupling (30) is shown as a bent elbow but may alternatively be a straight coupling.

E. Duct Coupling

As visible in FIG. 1 through FIG. 10, a duct coupling (40) passes through the top of the support (10, 22, 23) and is connected to the top of the support (10, 22, 23). The duct coupling (40) has two ends. The upper end of the duct coupling (40), which extends above the support (10, 22, 23), is utilized in connecting to a duct that exits through the building's exterior. The lower end of the duct coupling (40), which extends below the support (10, 22, 23), has the upper end of the flexible dryer vent hose (20) connected to it. The duct coupling (40) is shown as a straight coupling but may alternatively be a bent elbow.

F. Retraction Guide Assembly

Figure 11:
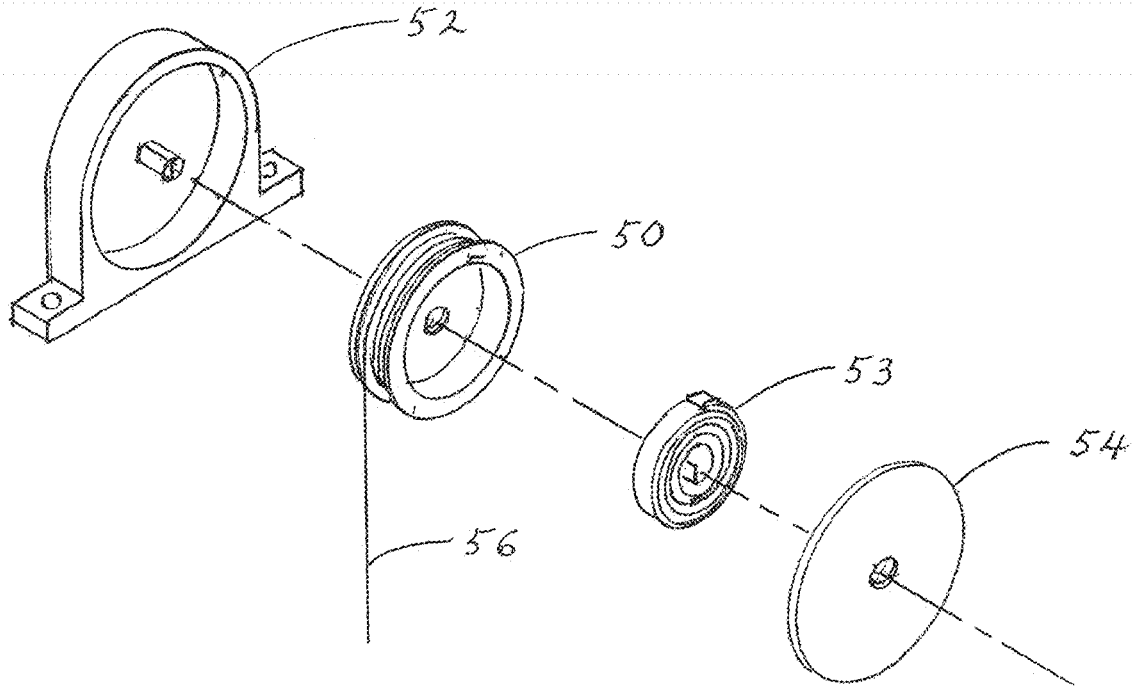
FIG. 11 shows an exploded view of a retractable spool assembly of a retractable clothes dryer vent.

Although shown in FIG. 1 through FIG. 9, a guide assembly is shown specifically in more detail in FIG. 10 and FIG. 11. The guide assembly includes a retractable spool assembly, a retractable line (56), a series of guide eyelets (57), and an anchor (31). The guide eyelets (57) are attached to the sides of the flexible dryer vent hose (20) in two rows on opposite sides of the flexible dryer vent hose (20), run parallel to the axis of the flexible dryer vent hose (20), and are in line with one another for the entire length of the flexible dryer vent hose (20). The openings in the guide eyelets (57) are large enough for the retractable line (56) to slide through freely without sliding restriction.

Figure 7:
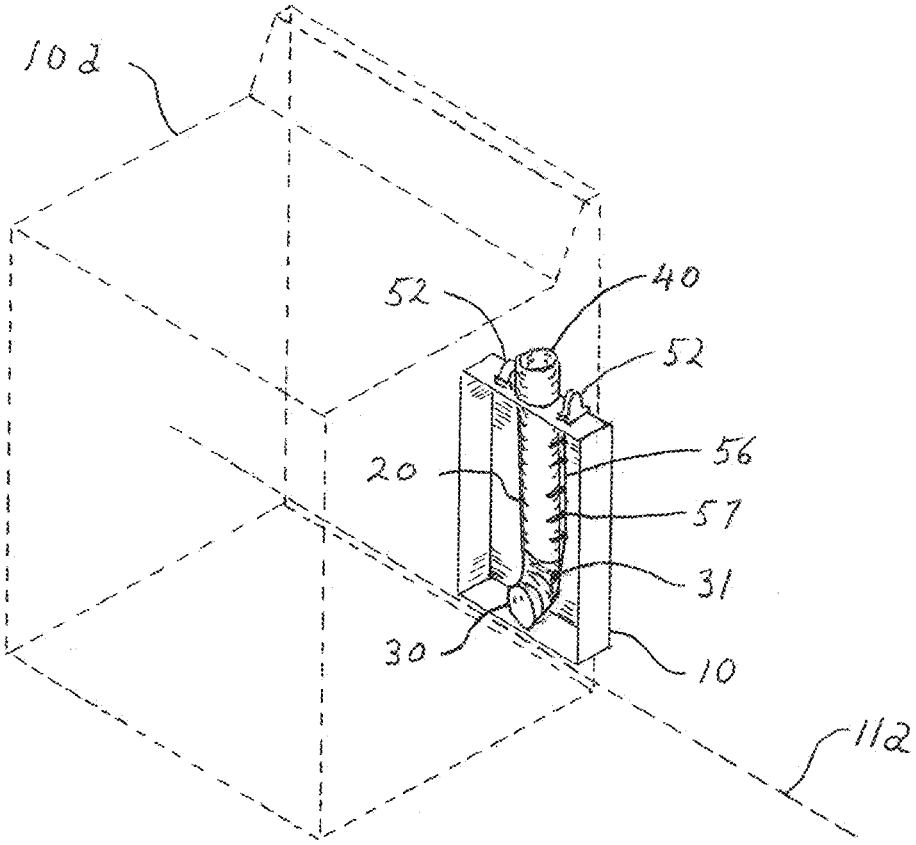
FIG. 7 shows an upper perspective view with a clothes dryer installed against the wall and attached to the retractable clothes dryer vent of FIG. 1.

Each retractable spool assembly, as shown in an exploded view in FIG. 11, includes a spool housing (52), a spring-loaded spool (50), a coil spring (53), and a spool housing cover (54). The retractable line (56) is wound around the spring-loaded spool (50) and exits the spool housing (52) though a small hole. The spring (53) imparts a moment to the spring-loaded spool (50) and, as the retractable line (56) is extended, produces torque, which maintains tension on the retractable line (56). The spool housing (52) has a flat base that connects to the top of the vent housing (10). Each retractable line (56) extends down through the vent housing (10) and is threaded through one row of guide eyelets (57) that are connected to the flexible dryer vent (20). The end of each retractable line (56) is fastened to one of the anchors (31) on the dryer exhaust coupling (30). The two retractable lines (56) have the same tension and work together to guide the flexible dryer hose (20) from a retracted position to an extended position and back to a retracted position. This allows the flexible dryer vent hose (20) to be connected to the dryer (10*a*) as shown in FIG. 6, before the dryer is moved into place. Then the dryer is moved into place, as shown in FIG. 7, at the base of a wall (11*a*) in which the support (10, 22, 23) is mounted without concern for kinking or twisting of the flexible dryer vent hose (20), which is a safety issue that could result in a fire.

An alternative to the retractable line (56) is an elastic line. This elastic line not only replaces the retractable line (56), but eliminates the need for a retractable spool assembly. One end of the elastic line is anchored to the top of the support (10, 22, 23), and the other end is threaded through a series of guide eyelets (57) and connected to the anchor (31) on the dryer exhaust coupling (30). There are preferably two elastic lines. Each elastic line runs through a series of guide eyelets (57) on opposite sides of the flexible dryer vent hose (20). The elastic lines have enough tension to keep the guide eyelets (57) in line and thus keep the flexible dryer vent hose from kinking.

An alternative to the guide assembly described above is a flexible dryer vent hose (20) made from an elastic material. The elastic flexible dryer vent hose is preferably elastic enough to extend to the dryer, without breaking, prior to moving the dryer (10*a*) into place. After the elastic flexible dryer vent hose is connected, the dryer (10*a*) is installed as depicted in FIG. 7. The elasticity of the elastic flexible dryer vent hose imparts enough tension to retract the dryer vent hose, accordion-like, and eliminate the possibility of kinking.

Another alternative to the guide assembly described above is an expandable lever system. These expandable levers are attached to the flexible dryer hose and support the dryer hose throughout its extension and contraction. Each end of this lever system is fastened to each end of the flexible dyer hose.

Another alternative to the guide assembly described above includes an alternative energy-storing device in place of the retractable spool assembly. Energy-storing devices include, but are not limited to, a tubular gas cylinder with piston and rod, a coil spring, and a counter weight with cord and pulley. In another variation, a motor replaces the retractable spool assembly.

G. Connections of Main Elements and Sub-Elements of Invention

The two retractable lines (56) control the alignment of the flexible dryer hose (20) throughout extension and retraction. This alignment eliminates the possibility of kinking the flexible dryer vent hose (20) when the clothes dryer (10*a*) is moved into its final operating position. The flexible dryer hose (20) is held in alignment and supported by the guide eyelets (57) that are attached to flexible dryer hose. The guide eyelets (57) are held in alignment by the retractable line (56), which has tension applied to it by the spring-loaded spool (50). The tension on the retractable line (56) is maintained by the attachment of the retractable line (56) to the anchor on the dryer exhaust coupling (30). The spring-loaded spool (50) gets its torque from the coil spring (53). The coil spring (53) has two ends. One end is attached to the spring-loaded spool (50) and the other end is affixed to the spool housing (52). The spool housing (52) is stationary in that it is fastened to the support (10, 22, 23).

H. Installation of a Clothes Dryer

The installation of a clothes dryer requires a connection of a vent to the outside, which is difficult to accomplish after the clothes dryer is in place, because the dryer exhaust is at the bottom rear of the dryer and the dryer is usually installed between the clothes washer and a wall. There are however, flexible vent hoses available that permit the vent to be connected to the clothes dryer before it is moved into its final position. These flexible vent hoses have a problem in that, when they are connected to the dryer and then the dryer is moved into its final position (installed), they twist and kink, which not only restricts the exhaust flow but lint builds up in the kinks and becomes a fire hazard. A retractable clothes dryer vent preferably eliminates these problems.

If a retractable clothes dryer vent is not already installed, a user preferably first installs the retractable clothes dryer vent. The installation includes either mounting the retractable clothes dryer vent between wall studs, which allows the dryer to be installed close to the wall, or mounting the retractable clothes dryer vent directly on the wall surface, which is necessary if the wall is masonry. Either before or after the retractable clothes dryer vent is mounted, a duct to the outside is connected to the retractable clothes dryer vent at the duct coupling (40). Next the user extends the flexible dryer vent hose (20) by grasping the dryer exhaust coupling (30) and connecting it to the dryer exhaust tube using a hose clamp. The user then slides the dryer (10*a*) into place. As the dryer (10*a*) is moved into place, the flexible dryer vent hose (20) is supported and kept in alignment by the two retractable lines (56) via the guide eyelets (57) which are attached to the dryer vent hose. As the dryer (10*a*) is moved closer to the wall, the retractable lines (56) becomes shorter but tension is maintained on them by the spring-loaded spool (50), which retracts part of the retractable lines (56) into the spool housing (52). Because the flexible dryer vent hose (20) has the guide eyelets connected to it, through which the retractable lines (56) run, the flexible dryer vent hose (20) is supported and guided, without kinking, back into its collapsed accordion state fully within the vent housing (10).

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A retractable clothes dryer vent comprising:

a support;

a duct coupling mounted in the support and having a first duct coupling end, a second duct coupling end opposite the first duct coupling end, and a duct coupling opening extending through the support;

a dryer vent hose having a first hose end extending from the first duct coupling end of the duct coupling and a second hose end opposite the first hose end;

a dryer exhaust coupling extending from the second hose end;

a first retraction guide assembly having a first retraction guide assembly first end mounted to the support and a first guide retraction guide assembly second end anchored to the dryer exhaust coupling; and a second retraction guide assembly having a second retraction guide assembly first end mounted to the support and a second guide retraction guide assembly second end anchored to the dryer exhaust coupling.

2. The retractable clothes dryer vent of claim 1, wherein:

the first retraction guide assembly comprises:

a first retractable spool assembly mounted to the support; and a first retractable line extending from a first line first end to a first line second end opposite the first line first end, wherein the first line first end is maintained in the first retractable spool assembly, the first line second end is anchored to the dryer exhaust coupling, and the first retractable line is retractable into the first retractable spool assembly; and the second retraction guide assembly comprises:

a second retractable spool assembly mounted to the support; and a second retractable line extending from a second line first end to a second line second end opposite the second line first end, wherein the second line first end is maintained in the second retractable spool assembly, the second line second end is anchored to the dryer exhaust coupling, and the second retractable line is retractable into the second retractable spool assembly.

3. The retractable clothes dryer vent of claim 2, wherein:

the first retractable spool assembly comprises:

a first retracting spool housing mounted to the support;

a first spool mounted and rotatable in the first retracting spool housing and coupled to the first line first end of the first retractable line; and a first coil spring mounted in the first retracting spool housing and biasing the first spool to retract the first retractable line; and the second retractable spool assembly comprises:

a second retracting spool housing mounted to the support;

a second spool mounted and rotatable in the second retracting spool housing and coupled to the second line first end of the second retractable line; and a second coil spring mounted in the second retracting spool housing and biasing the second spool to retract the second retractable line.

4. The retractable clothes dryer vent of claim 2 further comprising:

a plurality of first guide eyelets attached in a first row along a length of the dryer vent hose, the first retractable line extending through the plurality of first guide eyelets; and a plurality of second guide eyelets attached in a second row along the length of the dryer vent hose, the second retractable line extending through the plurality of second guide eyelets.

5. The retractable clothes dryer vent of claim 4 further comprising:

a first anchor on the dryer exhaust coupling aligned with the first row of first guide eyelets, wherein the first anchor anchors the first line second end of the first retractable line to the dryer exhaust coupling; and a second anchor on the dryer exhaust coupling aligned with the second row of second guide eyelets, wherein the second anchor anchors the second line second end of the second retractable line to the dryer exhaust coupling.

6. The retractable clothes dryer vent of claim 1, wherein the support comprises:

a vent housing comprising a first side wall, a second side wall, a third side wall, a fourth side wall, and a back wall forming a box shape; and a flange mounted to an open edge of the vent housing formed by the first side wall, second side wall, third side wall, and fourth side wall;

wherein the duct coupling is mounted in, and the first retraction guide assembly first end and the second retraction guide assembly first end are mounted to, the first side wall of the vent housing.

7. The retractable clothes dryer vent of claim 1, wherein the support comprises a shelf.

8. The retractable clothes dryer vent of claim 1, wherein the support comprises a wire frame.

9. The retractable clothes dryer vent of claim 1, wherein the dryer vent hose is flexible and retractable.

10. The retractable clothes dryer vent of claim 1, wherein the dryer exhaust coupling is an elbow coupling.

11. A method of installing a clothes dryer comprising the steps of:

a) pulling a dryer exhaust coupling of a retractable clothes dryer vent, mounted to a wall of a building, away from the wall, the retractable clothes dryer vent comprising:

a support mounted to the wall;

a duct coupling mounted in the support and having a first duct coupling end, a second duct coupling end opposite the first duct coupling end, and a duct coupling opening extending through the support;

a dryer vent hose having a first hose end extending from the first duct coupling end of the duct coupling and a second hose end opposite the first hose end;

the dryer exhaust coupling extending from the second hose end;

a first retraction guide assembly having a first retraction guide assembly first end mounted to the support and a first guide retraction guide assembly second end anchored to the dryer exhaust coupling; and a second retraction guide assembly having a second retraction guide assembly first end mounted to the support and a second guide retraction guide assembly second end anchored to the dryer exhaust coupling;

b) attaching the dryer exhaust coupling to a dryer exhaust tube of the clothes dryer; and c) moving the clothes dryer to an operational position at the wall with the dryer exhaust coupling attached to the dryer exhaust tube located vertically below the duct coupling.

12. The method of claim 11, wherein step a) comprises the substep of extending a first retractable line from a first retractable spool assembly of the first retraction guide assembly and extending a second retractable line from a second retractable spool assembly of the first retraction guide assembly;

the first retraction guide assembly comprising:

a first retractable spool assembly mounted to the support; and a first retractable line extending from a first line first end to a first line second end opposite the first line first end, wherein the first line first end is maintained in the first retractable spool assembly, the first line second end is anchored to the dryer exhaust coupling, and the first retractable line is retractable into the first retractable spool assembly; and the second retraction guide assembly comprising:

a second retractable spool assembly mounted to the support; and a second retractable line extending from a second line first end to a second line second end opposite the second line first end, wherein the second line first end is maintained in the second retractable spool assembly, the second line second end is anchored to the dryer exhaust coupling, and the second retractable line is retractable into the second retractable spool assembly.

13. The method of claim 11 further comprising the step of attaching the support of the retractable clothes dryer vent to the wall.

14. The method of claim 11 further comprising the step of inserting a vent housing of the support between a pair of studs in the wall and mounting a flange of the support to the wall, wherein the support comprises:

the vent housing comprising a first side wall, a second side wall, a third side wall, a fourth side wall, and a back wall forming a box shape; and the flange mounted around an open edge of the vent housing formed by the first side wall, second side wall, third side wall, and fourth side wall;

wherein the duct coupling is mounted in, and the first retraction guide assembly first end and the second retraction guide assembly first end are mounted to, the first side wall of the vent housing.

15. The method of claim 11 further comprising the step of attaching the second duct coupling end of the duct coupling to a duct leading outside the building.

* * * * *